United States Patent [19]

Anderson

[11] Patent Number: 4,499,967

[45] Date of Patent: Feb. 19, 1985

[54] SCAFFOLDING STAGING

[76] Inventor: Carl E. Anderson, 2581 Richmond Ter., Staten Island, N.Y. 10301

[21] Appl. No.: 549,922

[22] Filed: Nov. 9, 1983

[51] Int. Cl.[3] ..... E04G 5/08

[52] U.S. Cl. ..... 182/222; 182/145

[58] Field of Search ..... 182/222, 223, 119, 142, 182/143, 144, 145

[56] References Cited

U.S. PATENT DOCUMENTS

| | | | |
|---|---|---|---|
| 1,470,122 | 10/1923 | Schuler | 182/223 |
| 2,261,831 | 11/1941 | Farr | 182/223 |
| 2,916,102 | 12/1959 | Reinhardt | 182/143 |
| 3,306,397 | 2/1967 | Brumenshenkel | 182/223 |
| 3,374,861 | 3/1968 | Shaver | 182/222 |
| 3,628,628 | 12/1971 | Gilbreath | 182/222 |
| 4,002,222 | 1/1977 | Bruno | 182/145 |
| 4,382,488 | 5/1983 | Anderson | 182/145 |

FOREIGN PATENT DOCUMENTS

| | | | |
|---|---|---|---|
| 593770 | 3/1960 | Canada | 182/222 |

*Primary Examiner*—Reinaldo P. Machado

[57] ABSTRACT

An interconnected scaffolding platform having at least two elongated staging sections which are butted together so as to lie colinearly and in a common plane. A pair of lateral plates longitudinally project from the confronting ends of each of the sections. The plates are staggered with respect to each other to permit interfitting of the plates. A transverse bore is formed through all of the plates to define a passageway. A U-shaped bar arrangement interfits through the passageway and has depending arms which can secure the interconnected staging sections to a support member.

8 Claims, 4 Drawing Figures

SCAFFOLDING STAGING

BACKGROUND OF THE INVENTION

This invention relates to scaffolding, and more particularly to an interconnected scaffolding platform comprising staging sections which are butted together in a coplanar arrangement.

Elongated staging sections are typically utilized in various types of scaffolding systems. Typically, the staging sections include elongated planks of wood or steel with side walls. The staging sections are typically placed across support arms and provide a catwalk for construction or repairman to stand.

One typical usage of such staging sections is in connection with installation of siding on a building. Generally, elongated poles will be placed in spaced arrangement from the wall of the building to be sided. The poles will be supported by braces. Pump jacks are then placed on the poles. The pump jacks generally include an extended support arm. The elongated staging sections are then placed across a pair of spaced apart support arms so as to position the staging section parallel to the wall. The construction workers can then stand on the staging sections and install the siding.

In the arrangement described, the workers can also manipulate the pump jack while standing on the staging so as to move the pump jack up the poles thereby raising the level of the elongated staging along the wall to be sided.

It is frequently necessary to provide more than one elongated staging section. Since the staging sections come with a fixed length, numerous such sections are utilized and are longitudinally placed so as to form a continuous catwalk along which the workers can move during installation of the siding.

Normally, each staging section terminates in a conventional end arrangement. Such arrangement can include rounded edges to avoid cutting of the workers and could also include a transverse pole handle to facilitate grasping of the staging section and moving it.

The problem, however, is to place two such elongated sections longitudinally adjacent to each other. Typically, one staging section is placed across the spaced apart support arms and is held in a planar arrangement parallel to the ground surface. When another section is desired to be extended longitudinally therefrom, the next adjacent section is placed so that its end overlies the end of the first section and longitudinally extends therefrom. As a result, there will be a double layer of the staging sections at the support arms.

Having two sections one on top of the other, is a hazardous condition. The sections can slide from one another, the workers can trip as they move from one section to the other, the overlying condition causes one section to be raised thereby making it angular rather than planar, and, in addition, one section can easily tilt with respect to the other to cause the worker to fall off balance.

Normally, the support arms are not very long and therefore there is insufficient room to place the elongated staging sections adjacent one to the other rather than overlying the ends. Furthermore, even if the two sections would be placed adjacent to each other they would no longer be colinear and again would cause safety problems. The worker walking from one section to the other would have to make a dogleg step and, should he neglect to do this, would fall off one section and not get to the next section. Futhermore, it spaces one staging section further away from the wall than the other section.

Accordingly, conventionally, there is no satisfactory way to interconnect two elongated staging sections in a safe and easy manner.

SUMMARY OF THE INVENTION

Accordingly, it is an object of the present invention to provide an interconnected scaffolding platform which avoids the aforementioned problems of prior art devices.

A further object of the present invention is to provide at least two elongated staging sections which can be butted together.

A further object of the present invention is to provide at least two elongated staging sections which can be interconnected so as to lie in a colinear and coplanar arrangement.

Still a further object of the present invention is to provide an interconnected scaffolding platform having at least two elongated staging sections which are interconnected by a coupling arrangement whereby the ends of the staging sections form a substantially continuous catwalk.

Yet another object of the present invention is to provide at least two elongated staging sections having their ends fitted together so as to prevent the ends from separating or shifting apart.

Briefly, in accordance with the present invention, there is provided an interconnected scaffolding platform having at least two elongated staging sections which are butted together. A pair of lateral plates longitudinally project from the confronting ends of each of the sections. Each pair of plates are staggered with respect to the other pair so as to permit a mating interfit of the two pairs of plates together. Each plate has a transverse bore formed therethrough. When the plates are in their interfit position, the bores are aligned so as to define a passageway transverse to the staging sections. A coupling arrangement extends through the passageway so as to securely interconnect the sections together. In this manner, the sections will lie colinearly and in a common plane.

In an embodiment of the invention, the coupling arrangement includes two L-shaped tubes which telescopically interconnect so as to define an inverted U-shaped bar. The bight portion is telescopically interconnected and extends through the passageway. The two arms of the U-shaped arrangement depend downwardly and fit into a receiving slot provided in the support arm on the pump jack. At the distal ends of the arms there are provided pivoted locking arrangements to prevent extraction of the arms from the receiving slot in the support arm.

The foregoing objects, features and advantages of the invention will, in part be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENT

Figure 1:
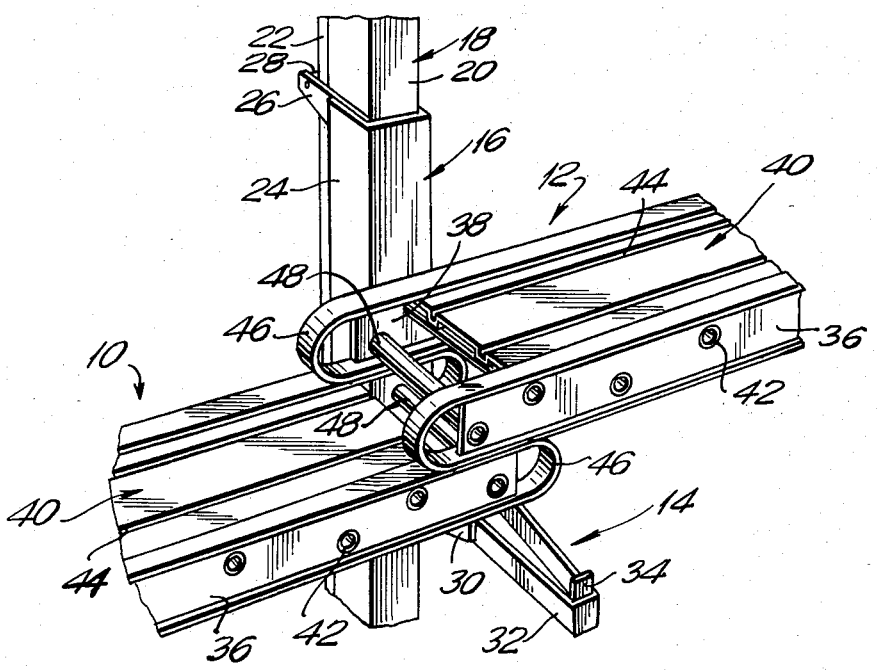
(PRIOR ART) FIG. 1
FIG. 1 is a perspective view of a pair of elongated staging sections placed adjacent to each other in overlying arrangement and supported by the support arm of a pump jack in accordance with the prior art arrangements.

Referring now to FIG. 1, there is shown a pair of adjacent elongated staging sections 10, 12 which are both supported on a platform arm 14 extending from a pump jack 16 which rides up and down a pump jack pole 18. The pump jack pole shown can be of a type described in my U.S. Pat. No. 4,382,488 issued May 10, 1983. In such patent, the pump jack pole is of substantially rectangular cross sectional aluminum tubing 20 having a rubberized surface 22 on one side thereof. However, other types of pump jack poles could as well be utilized, whether they be of metal, wood, or the like.

The pump jack can be of any standard pump jack configuration which rides up and down the pump jack pole. Such pump jacks are well known in the art and are used for ascending and descending along the pole. One such improved pump jack pole is described in my copending U.S. Application Ser. No. 332,015 filed Dec. 18, 1981.

The pump jack pole shown in FIG. 1 is only schematically indicated as including a three sided member 24 having a pair of opposing side arms 26 through which pass a roller 28 abutting against the pole surface 22. Appropriate climbing mechanism would be provided on the pump jack in order to permit the pump jack to ascend and descend the pole, as is well known in the art.

The particular arm 14 is supported on the pump jack by means of a pair of opposing plates 30 and includes a forward U-shaped section 32 which typically pivots upward and outward from the opposing plates 30.

An upstanding stop 34 is provided at the distal end to prevent any platform from sliding off the support arm.

The particular staging sections are each shown to include opposing I-shaped beams 36, 38 which support a surface 40 along which the workers can walk. The surface can be supported by means of the poles 42 spaced apart along the longitudinal length of the I-beams and extending transverse thereacross. Typically, the surface 40 would include sections which include spacing 44 therebetween.

At the forward end of each staging section, the I-beams terminate in a rounded forward nose portion 46 which can serve as handles to grasp the staging section and also serve to prevent cutting of a worker by avoiding sharp corners. The forward end pole 48 is spaced in front of the upper surface 40 and can serve as a handle for grasping one end of the staging section. The adjacent staging section 10 is substantially identical to the staging 12 and is identified by corresponding numerals.

Typically, the poles 18 will be spaced apart and vertically raised adjacent to a wall being worked on. The poles will be supported from the wall by means of bracing. The pump jacks will be placed on each of the poles. The staging sections will span between the adjacent pump jacks.

When the length of the scaffolding is greater than the single length of a staging section, it is necessary to utilize adjacent sections. Typically, as shown in FIG. 1, one staging section 10 would lie upon the arms of adjacent pump jacks. The next adjacent section 12 would be placed so as to overlie the end of the staging section 10 and span to the next arm of the next pump jack.

It is well appreciated, that the extension arrangement provided in FIG. 1 is hazardous and can easily cause safety concerns. For example, a worker moving along the platform can easily trip over the next section of staging as he moves from one section to the next, because the next section is raised. A further problem is that the two adjacent sections can easily slide off each other. Although the upturned end 34 provides somewhat of a guard, because the section 12 is raised at such a high level over the section 10, it can easily slide off and over the upturned end 34 so as to completely fall off the entire arm.

Other safety problems are that frequently the section 12 may be angled if it lies at a higher level on one end and a lower level on the other. Another problem is that both sections can actually separate apart and each section can slide off the arm whereby both sections can fall off the arm.

Even if one were to remove the section 12 and place it laterally against the side of section 10, assuming that the arm 14 would have sufficient room for both sections, there would still be safety problems. The individual walking along one section would forget to dogleg to the next section and would therefore continue colinearly and miss an entire platform and fall down. Other such similar safety problems are self evident.

Nevertheless, despite all of the previously mentioned safety problems, the arrangement shown in FIG. 1 is one that was in standard use in connection with utilizing staging sections in construction and industrial use. For example, in the installation of siding, the arrangement shown in FIG. 1 is standard accepted practice in the industry.

Figure 2:
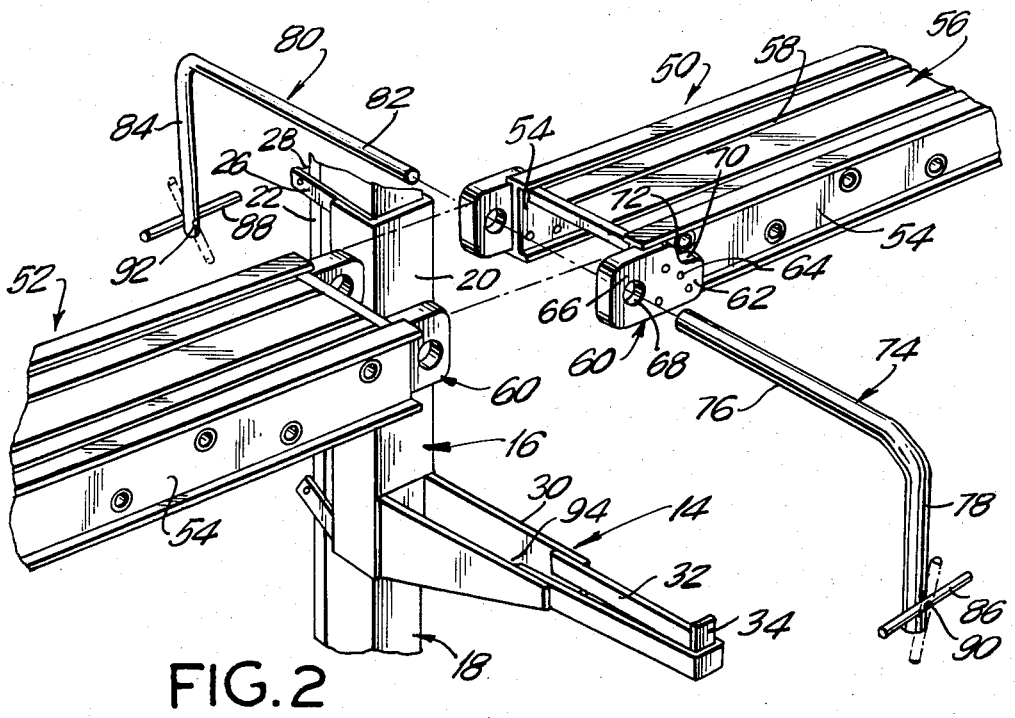
FIG. 2 is an exploded perspective view of the interconnected scaffolding platform of the present invention in association with the pump jack and support arm.
Figure 3:
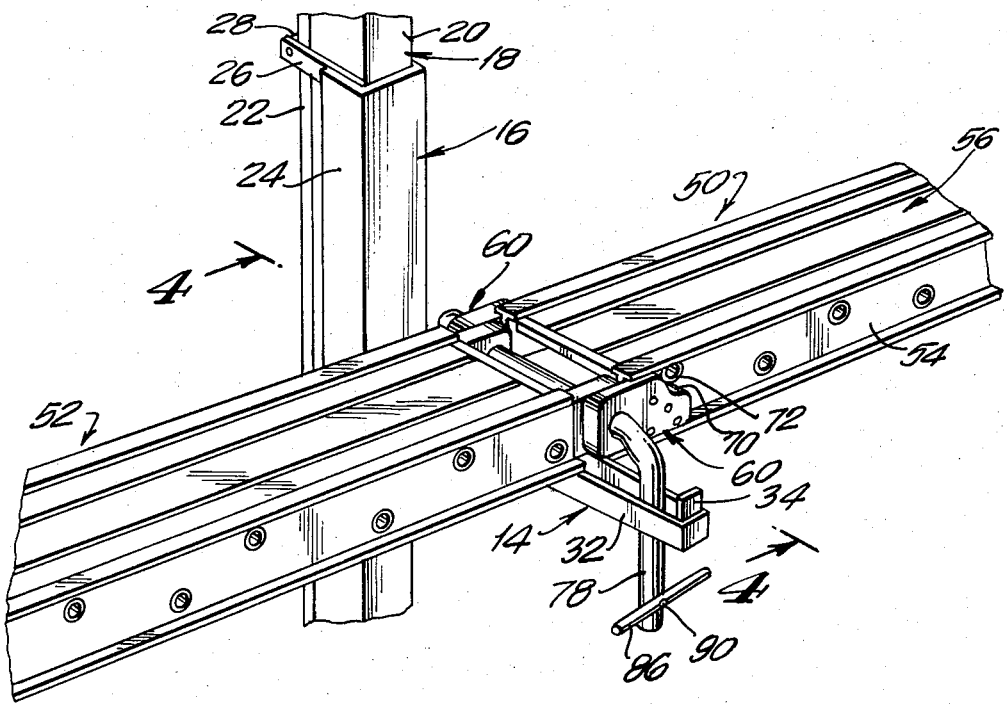
FIG. 3 is a perspective view of the interconnected scaffolding platform in its assembled condition supported by the pump jack.
Figure 4:
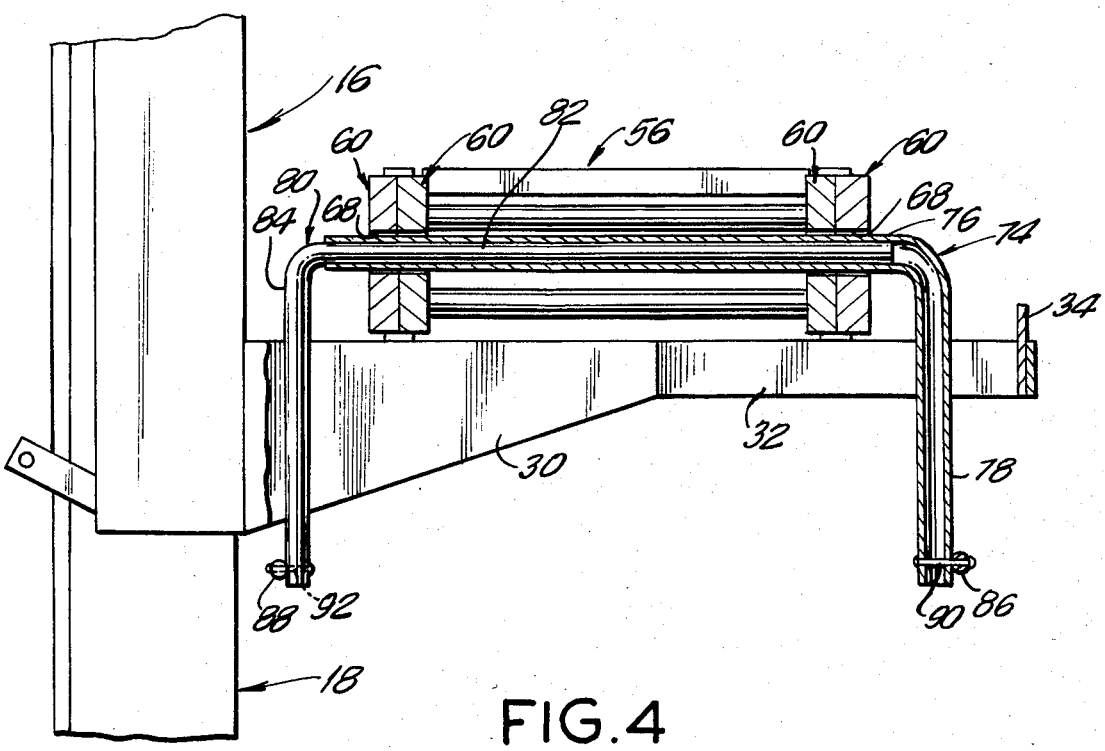
FIG. 4 is a cross sectional view taken along lines 4—4 of FIG. 3 and showing the interconnected staging sections.

Referring now to FIGS. 2–4, the improved interconnecting arrangement of elongated staging sections will now be described. As shown in the figures, there is again provided the pole 18 having the pump jack 16 riding up and down the pole with the support arm 14 supporting the two adjacent elongated staging sections.

Each of the staging sections 50, 52 are again formed of an opposing pair of I beams 54 which support a top surface 56. The top surface is typically formed of aluminum strips with spaces or recesses 58 formed between the strips.

At the end of a section, the I-beams terminate at substantially the same location at which the surface 56 ends. However, the I-beams and the platform end in a pair of opposing side plates 60. Each side plate projects from the edge of the staging section. The plate is conveniently shown having a rearward section 62 which is secured to the I-beam by means of fasteners 64 such as rivets, or the like. A forward section thereof, 66 which extends beyond the staging includes a bore 68 formed therethrough.

The pair of plates 60 extending from the section 50 are arranged so that the bores 68 therethrough are aligned. Furthermore, the bores in the plates 60 extending from the staging section 53, adjacent thereto are also aligned and are arranged such that when they are placed adjacent to the section 50, the bores in all four plates will be coaligned as shown in FIG. 3.

In order to interfit the two ends, the pair of plates on section 50 are shown to be placed in the channel on the outer side of the I-beams. On the other hand, the plates 60 at the end of the staging section 52 are placed on the channels on the inner side of the I-beams 54. In this manner, when the two staging sections are brought together, the inside plates 60 on the staging section 52 will fit inbetween the plates 60 on the staging section 50. The bores 68 of all four plates, will then be aligned.

It should be noted, that for convenience, the rear sections 62 of the plate 60 includes a cut out 70 to accommodate the pole 72 which is formed in the staging section for support of the surface 56.

In order to retain the staging sections interconnected, and secure them properly onto the support arm 14, a coupling arrangement is provided. The coupling arrangement includes a first L-shaped section 74 formed of tubular material and including a horizontal section 76 and a downwardly depending vertical section 78. An opposing L-shaped section 80 includes a horizontal leg 82 and a downwardly depending vertical leg 84. The leg 82 has a smaller diameter as compared to the tubular legs 76 so as to be telescopically received therein.

At the distal ends of both arms 78 and 84 there is provided a respective transverse pin 86, 88 which is pivotally held in place by means of a rivet 90, 92, or the like. The pins 86, 88 can thereby pivot into a position transverse to the legs 74, 84. They can be spring held in place whereby they will be retained in the transverse position until reoriented so as to be colinear with the respective legs 78, 84.

In assembling the adjacent staging section, the two sections are placed onto the support arm 14 and the plates 60 at the two confronting ends interfitted and arranged so that there is provided an aligned passageway defined by the bores 68. The L-shaped member 74 is inserted so that the leg 76 extends through the passageway defined by the bores 68. The opposing L-shaped section 80 is then arranged so that the leg 82 is telescopically received within the legs 74. The two depending legs 78, 84 are then inserted into the opening 94 provided in the arm 14. The pins 86, 88 are then rotated into the transverse position so as to prevent the legs 78, 84 from pulling out of the arm 14.

It will be noted, that the coupling arrangement serves a two fold purpose. On the one hand, it provides a coupling interconnection so as to butt join the elongated scaffolding sections. As the same time, it also serves to retain both sections securely held within the support arm 14 so as to prevent either of the sections from sliding off the support arm.

As a result of the interconnection, a butt joint is provided whereby the adjacent elongated scaffolding staging sections are colinear and at the same time lie in a coplanar orientation. A worker will therefore be able to walk directly from one staging section to the other without any noticable change in the surface. The staging sections will thereby effectively present a continuous, uniform catwalk along which the worker can move and no hazardous junction will be provided between the sections.

In order to separate the sections, the pins 86, 88 are rotated so as to lie colinearly with their respective legs 78, 84. The legs 78, 84 are then lifted from the opening 94 provided in the support arm 14 and the two L-shaped sections telescopically removed from each other. The two staging sections can then be separated.

Although the staging sections were heretofore described in connection with pump jacks and pump jack poles, it should be appreciated that the staging sections can find use in numerous types of scaffolding arrangements.

There has been disclosed heretofore the best embodiment of the invention presently contemplated. However, it is to be understood that various changes and modifications may be made thereto without departing from the spirit of the invention.

I claim:

1. An interconnected scaffolding platform, comprising:

at least two elongated staging sections to be butted together;

a pair of end portions longitudinally projecting from the confronting ends of each section, each pair being staggered with respect to the other pair, so as to permit a mating interfit of the two pairs of end portions;

each of said end portions having a transverse bore therethrough, said bores being aligned in the interfit position of the end portions so as to define a passageway transverse to the sections, and coupling means for extending through said passageway to securely interconnect said sections together, whereby the interconnected sections will lie colinearly in a common plane, said coupling means comprising an inverted U-shaped bar arrangement having one portion defining a bight portion extending through said passageway and other portions defining depending arms to retain the bar arrangement positioned through said passageway, wherein said interconnected platform rests on a support member having a vertical receiving slot therein for receiving said depending arms, and comprising locking means at the distal ends of said depending arms for preventing removal of said arms from said receiving slot.

2. An interconnected scaffolding platform as in claim 1, wherein said bar arrangement comprises two L-shaped sections having telescopically interfitting legs to form said U-shaped arrangement.

3. An interconnected scaffolding platform as in claim 2, wherein at least one of said L-shaped sections if formed of tubular material so as to define a sleeve for receiving the other of said L-shaped sections.

4. An interconnected scaffolding platform as in claim 1, wherein said locking means comprise a pin pivoted at the end of said arms to rotate into a position transverse to said arms.

5. An interconnected scaffolding platform as in claim 1, wherein said staging sections comprise a pair of opposing I-beams and a base platform supported by said I-beams, one pair of end portions being located at the outside channel of the I-beams forming it corresponding staging section, and the other pair of end portions being located on the inside channel of the I-beams forming its corresponding staging section.

6. An interconnected scaffolding platform as in claim 5, and comprising fastening means for securing said end portions to the web of the I-beams.

7. An interconnected scaffolding platform as in claim 6, wherein said end portions comprise a first part thereof secured to the web of the I-beams and a second part thereof longitudinally extending from the I-beams and having said transverse bore therethrough.

8. An interconnected scaffolding platform as in claim 7, wherein the length of said end portions projecting beyond said staging sections is greater than the width of said support member.

* * * * *